US008092874B2

(12) United States Patent
Wexler et al.

(10) Patent No.: US 8,092,874 B2
(45) Date of Patent: Jan. 10, 2012

(54) INKJET MEDIA SYSTEM WITH IMPROVED IMAGE QUALITY

(75) Inventors: Allan Wexler, Pittsford, NY (US); James A. Reczek, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 331 days.

(21) Appl. No.: 12/394,150

(22) Filed: Feb. 27, 2009

(65) Prior Publication Data

US 2010/0221460 A1 Sep. 2, 2010

(51) Int. Cl.
*B41M 5/40* (2006.01)

(52) U.S. Cl. ..... 428/32.3; 428/32.34; 428/32.36; 428/32.37

(58) Field of Classification Search ..... 428/32.3, 428/32.34, 32.36, 32.37
See application file for complete search history.

(56) References Cited

U.S. PATENT DOCUMENTS

| | | | | |
|---|---|---|---|---|
| 5,500,668 | A | 3/1996 | Malhotra et al. | |
| 6,207,258 | B1 | 3/2001 | Varnell | |
| 6,357,870 | B1 | 3/2002 | Beach et al. | |
| 6,398,357 | B1 | 6/2002 | Holloway et al. | |
| 6,492,005 | B1 * | 12/2002 | Ohbayashi et al. | 428/32.29 |
| 6,550,903 | B2 | 4/2003 | Katsuragi et al. | |
| 6,779,884 | B1 | 8/2004 | Ma et al. | |
| 6,827,434 | B1 | 12/2004 | Katsuragi et al. | |
| 7,157,504 | B2 | 1/2007 | Ma et al. | |
| 2001/0030678 | A1 * | 10/2001 | Katsuragi et al. | 347/101 |
| 2005/0206705 | A1 | 9/2005 | Ma et al. | |
| 2005/0231573 | A1 | 10/2005 | Bruinsma et al. | |
| 2006/0051528 | A1 | 3/2006 | Ogino et al. | |
| 2006/0088672 | A1 | 4/2006 | Totani et al. | |
| 2008/0075847 | A1 | 3/2008 | Kobayashi | |

FOREIGN PATENT DOCUMENTS

| | | |
|---|---|---|
| JP | 2004-359799 | 12/2004 |
| JP | 2005-119014 | 5/2005 |
| JP | 2005 262797 A | 9/2005 |
| JP | 2007-230080 | 9/2007 |

OTHER PUBLICATIONS

George Eby: "Stability Constants of Various Metal Chelates", XP002583663, Retrieved from the Internet: URL:http://www.coldcure.com/html/stability_constants.html>, [retrieved on May 21, 2010], table.

* cited by examiner

*Primary Examiner* — Betelhem Shewareged
(74) *Attorney, Agent, or Firm* — Andrew J. Anderson

(57) ABSTRACT

An inkjet printing system, comprises: a printer, a pigment ink composition, and a dry recording media supply for receiving ink, the media comprising a support bearing an ink-receiving layer containing a complex of a polyvalent metal cation and a ligand, wherein the complex has a stability constant, K1, in the range of 0.3 to 6.0. The system gives images with excellent gloss, coalesence, and image quality.

16 Claims, 2 Drawing Sheets

INKJET MEDIA SYSTEM WITH IMPROVED IMAGE QUALITY

FIELD OF THE INVENTION

The invention relates to a coated inkjet receiver media suitable for high-quality inkjet printing, a method for its manufacture, and a method of printing on the paper with an inkjet printer. More specifically, the invention relates to an inkjet recording media with excellent printed color density, gloss, and image quality. The inkjet recording media are well suited for printing with pigment-based inks.

BACKGROUND OF THE INVENTION

In a typical inkjet recording or printing system, ink droplets are ejected from a nozzle at high speed towards a recording element or medium to produce an image on the medium. The ink droplets, or recording liquid, generally comprise a recording agent, such as a dye or pigment, and a large amount of solvent. The solvent, or carrier liquid, typically is made up of an aqueous mixture, for example, comprising water and one or more organic materials such as a monohydric alcohol, or a polyhydric alcohol.

An inkjet recording media typically comprises a support having on at least one surface thereof at least one ink-receiving layer (IRL). There are generally two types of IRLs. The first type of IRL comprises a non-porous coating of a polymer with a high capacity for swelling, which non-porous coating absorbs ink by molecular diffusion. Cationic or anionic substances may be added to the coating to serve as a dye fixing agent or mordant for a cationic or anionic dye. Typically, the support is a smooth resin-coated paper and the ink-receiving layer is optically transparent and very smooth, leading to a very high gloss "photo-grade" inkjet recording media. However, this type of IRL usually tends to absorb the ink slowly and, consequently, the imaged receiver or print is not instantaneously dry to the touch.

The second type of ink-receiving layer or IRL comprises a porous coating of inorganic, polymeric, or organic-inorganic composite particles, a polymeric binder, and optional additives such as dye-fixing agents or mordants. These particles can vary in chemical composition, size, shape, and intra-particle porosity. In this case, the printing liquid is absorbed into the open interconnected pores of the IRL, substantially by capillary action, to obtain a print that is instantaneously dry to the touch. Typically the total interconnected inter-particle pore volume of porous media, which may include one or more layers, is more than sufficient to hold all the applied ink forming the image.

As the desire for photographs reproduced by inkjet printing technology grows, there is increased demand for improved image quality. Historically, receivers with swellable layers of bydrophilic polymers on glossy resin-coated papers were used for photographs, but these receivers dried slowly and were inconvenient to handle until dry. Porous-design photo papers provide prints that are dry-to-the-touch upon exit from the printer. In addition, the demand for high color density requires a receiver with high capacity for ink. Lack of capacity results in pooling of ink droplets on the surface of the receiver, leading to the phenomena observed as coalescence or mottle. A further demand is for high-speed printing. Consequently, as ink flux increases capacity alone may not be sufficient for proper absorption of ink droplets.

In providing at least a partial solution to these demands, various technologies for fixing or immobilizing the ink droplets on the receiver surface have been proposed. This serves to reduce mixing that results in coalescence and increases the concentration of colorant at or near the surface, increasing density. In the case of dye-based aqueous inks used in inkjet printing, the dyes generally comprise anionic moieties and are known to complex with suitable cationic species, thus binding the dye near the surface to ensure high color density. For dye-based inks, the preferred fixing agent is often called a mordant and may comprise a salt of a quaternary nitrogen moiety, frequently in polymeric form, or a salt of a multivalent metal cation.

A particular challenge with pigment-based inks is that the penetration of the fluid portion of the ink may be slowed if the pigment particles partially block the pores of the media. Since the fluid stays on the surface longer, drops may mix and initiate coalescence and the appearance of mottle. The level of mottle can be significantly reduced by the addition of fixing agents. The preferred fixing agents are multivalent metal cations. One solution is to provide a salt of a cationic fixing agent in the receiver as manufactured and another is for the printer to deliver a solution to the receiver comprising such a salt either by coating, spraying or jetting. The solution may be applied to the receiver in various sequences, including immediately prior to, concurrently with, or immediately following jetting of the ink droplets.

Katsuragi, et al., in U.S. Pat. No. 6,550,903, disclose liquid compositions, ink sets, apparatus, and processes for inkjet recording on plain paper. A first liquid containing a polyvalent salt of a metal cation and a second liquid containing a coloring material are used in combination and applied on a plain paper so as to come into contact with each other. Katsuragi, et al., disclose the salt of a polyvalent metal cation with a polyhydroxycarboxylic acid for improving the water-fastness of pigment-based inks printed on plain paper. Furthermore, an improvement in image sharpness and a reduction in feathering are alleged, along with resistance to bleeding when different colors are printed adjacent to one another, specifically when one of the inks is a black ink. Printing systems that include printer-applied fixing solutions involve extra complexity, extra solution supplies and extra delivery systems. Drying times are increased when extra aqueous solutions are applied to the receiver. A problem of principal concern when jetting a fixing agent via printhead is that the fixing agent will contaminate the printhead and cause fouling and other concerns.

A problem not mentioned in '903, since it dealt only with a system employing plain, uncoated paper as the receiver, is that for glossy photo-quality media, the addition of salts of multivalent metal cations results in a severe loss of gloss in prints with pigment-based inks. Thus, a simple printing system is needed to provide photographs that are instantly dry-to-the-touch, employ colorants resistant to fade over a lifetime, and exhibit superb image quality with minimal coalescence and mottle, and high gloss.

SUMMARY OF THE INVENTION

The invention provides an inkjet printing system, comprising: a printer, a pigment ink composition, and a dry recording media supply for receiving ink, the media comprising a support bearing an ink-receiving layer containing a complex of polyvalent metal cation(s) and ligand(s), wherein the complex has a stability constant, K1, in the range of 0.3 to 6.0. The system provides reduced coalescence and mottle, high gloss, and excellent image quality.

The invention also provides an improved inkjet media and a process for making such a media.

BRIEF DESCRIPTION OF THE DRAWINGS

The above and other objects, features, and advantages of the present invention will become more apparent when taken in conjunction with the following description and drawings wherein identical reference numerals have been used, where possible, to designate identical features that are common to the figures, and wherein.

DETAILED DESCRIPTION OF THE INVENTION

The invention is summarized above. Inkjet printing systems useful in the invention comprise a printer, at least one ink, and an image recording element, typically a sheet, (herein also "media"), suitable for receiving ink from an inkjet printer. Inkjet printing is a non-impact method for producing printed images by the deposition of ink droplets in a pixel-by-pixel manner to an image-recording media in response to digital data signals. There are various methods that may be utilized to control the deposition of ink droplets on the image-recording media to yield the desired printed image. In one process, known as drop-on-demand inkjet, individual ink droplets are projected as needed onto the image-recording media to form the desired printed image. Common methods of controlling the projection of ink droplets in drop-on-demand printing include piezoelectric transducers, thermal bubble formation or an actuator that is made to move.

Drop-on-demand (DOD) liquid emission devices have been known as ink printing devices in inkjet printing systems for many years. Early devices were based on piezoelectric actuators such as are disclosed by Kyser et al., in U.S. Pat. No. 3,946,398 and Stemme in U.S. Pat. No. 3,747,120. A currently popular form of inkjet printing, thermal inkjet (or "thermal bubble jet"), uses electrically resistive heaters to generate vapor bubbles which cause drop emission, as is discussed by Hara et al., in U.S. Pat. No. 4,296,421. In another process, known as continuous inkjet, a continuous stream of droplets is generated, a portion of which are deflected in an image-wise manner onto the surface of the image-recording media, while un-imaged droplets are caught and returned to an ink sump. Continuous inkjet printers are disclosed in U.S. Pat. Nos. 6,588,888; 6,554,410; 6,682,182; 6,793,328; 6,866,370; 6,575,566; and 6,517,197.

Figure 1:
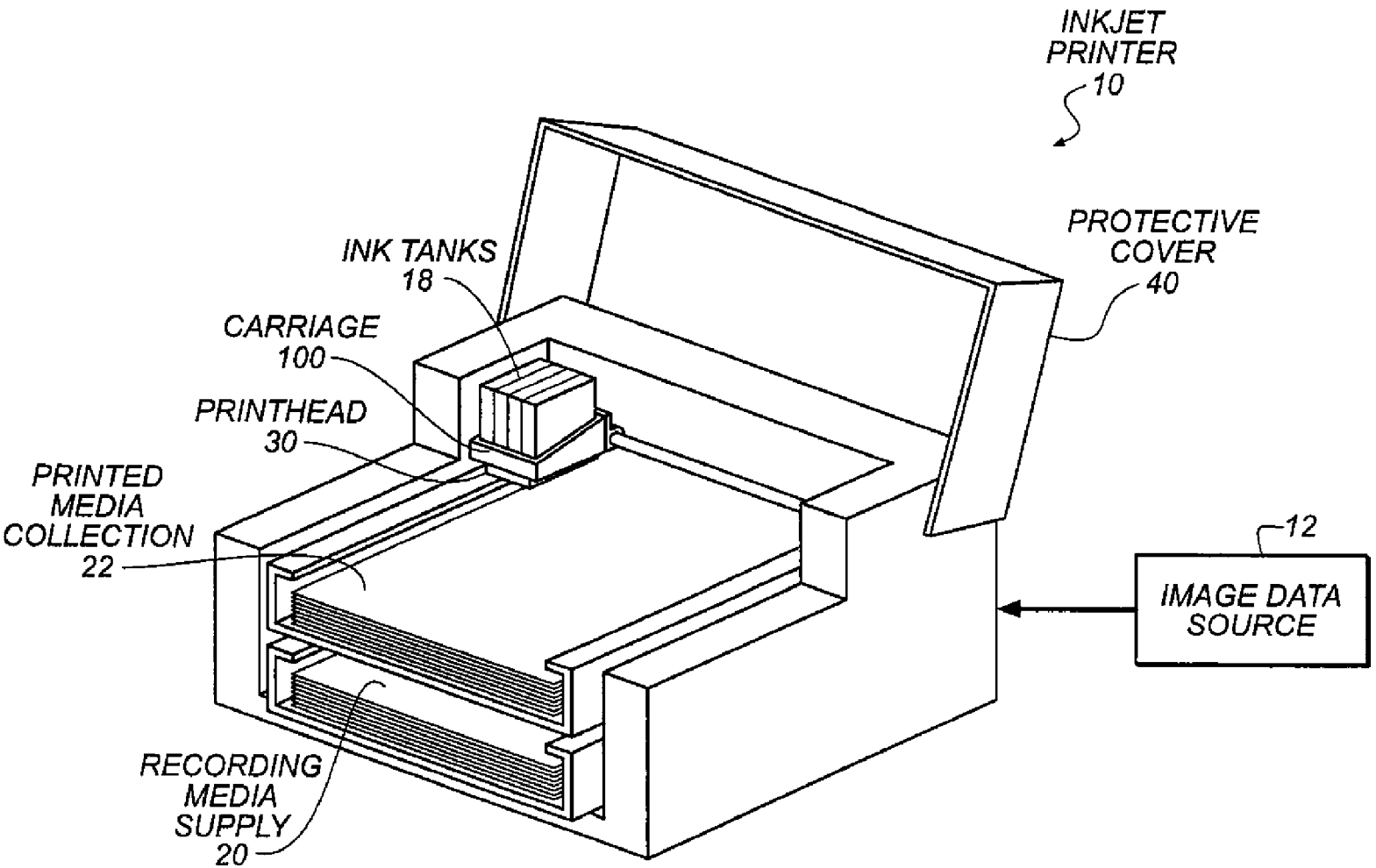
FIG. 1 is a schematic view of an inkjet printer useful in the invention.

FIG. 1 shows one schematic example of an inkjet printer 10 that includes a protective cover 40 for the internal components of the printer. The printer contains a dry media supply 20 in a tray. The printer includes one or more ink tanks 18, which together make up an ink set, (shown here as having four inks) that supply ink to a printhead 30. The printhead 30 and ink tanks 18 are mounted on a carriage 100. The printer includes a source of image data 12 that provides signals that are interpreted by a controller (not shown) as being commands to eject drops of ink from the printhead 30. Printheads may be integral with the ink tanks or separate. Exemplary printheads are described in U.S. Pat. No. 7,350,902. In a typical printing operation a media sheet travels from the recording media (or inkjet receiver) supply 20 in a media supply tray to a region where the printhead 30 deposits droplets of ink onto the media sheet. The printed media collection 22 is accumulated in an output tray.

Figure 2:
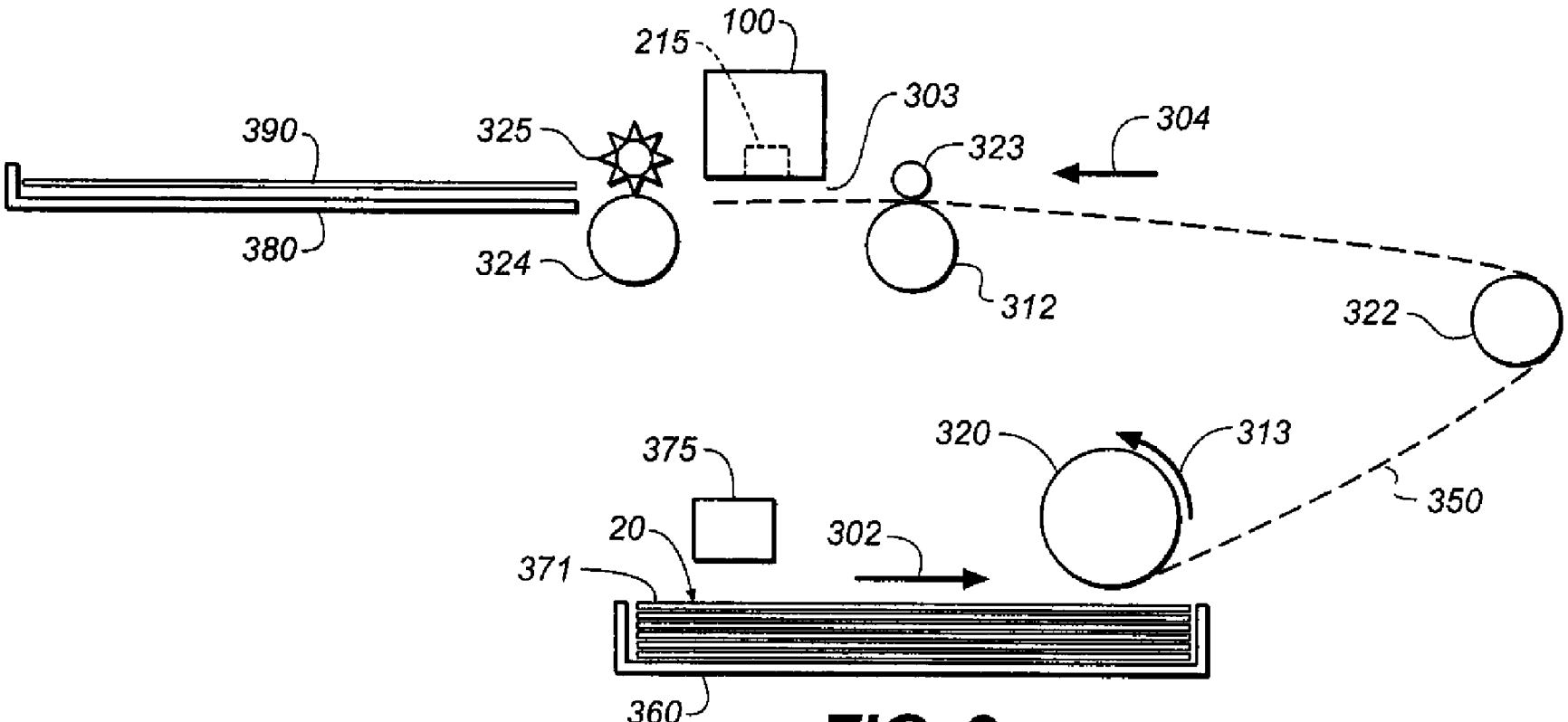
FIG. 2 is a schematic diagram showing the flow of media from the supply tray of an inkjet printer to the collection tray.

FIG. 2 shows schematically how the inkjet printer comprises a variety of rollers to advance the media sheet, through the printer, as shown schematically in the side view of FIG. 2. In this example, a pickup roller 320 moves the top media sheet 371 of a stack 20 of media that is located in a media supply tray 360 in the direction of arrow 302. A turn roller 322 acts to move the media sheet 371 around a C-shaped path 350 (in cooperation with a curved surface-not shown) so that the media sheet continues to advance along direction arrow 304 in the printer. The media sheet 371 is then moved by feed roller 312 and idler roller(s) 323 to advance along direction 304 across the print region 303 and under printer carriage 100. A discharge roller 324 and star wheel(s) 325 transport the printed media sheet 390 along direction 304 and to an output tray 380. For normal media pick-up and feeding, it is desired that all driven rollers rotate in forward direction 313. An optional sensor 215 capable of detecting properties of the media sheet or indicia contained thereon can be mounted on the carriage 100. A further optional sensor 375 capable of detecting properties of the media sheet or indicia contained thereon may be positioned facing the front or back surface of the media sheet 371 and located at any advantageous position along the media transport path 350 including the media supply tray 360. Alternatively, the inkjet printing system comprises a printer supplied with a continuous roll of ink recording medium that may be cut to individual prints subsequent to printing.

Different types of image-recording elements (media) vary widely in their ability to absorb ink. Inkjet printing systems provide a number of different print modes designed for specific media types. A print mode is a set of rules for determining the amount, placement, and timing of the jetting of ink droplets during the printing operation. For optimal image reproduction in inkjet printing, the printing system must match the supplied media type with the correct print mode. The printing system may rely on the user interface to receive the identity of the supplied media, or an automated media detection system may be employed. A media detection system comprises a media detector, signal conditioning procedures, and an algorithm or look-up table to decide the media identity. The media detector may be configured to sense indicia present on the media comprising logos, or patterns corresponding to media type, or may be configured to detect inherent media properties, typically optical reflection. The media optical sensor may be located in a position to view either the front or back of the media sheet, depending on the property being detected. As exemplified in FIG. 2, the optical sensor 375 may be located to view the media sheet 371 in the media supply tray 360 or along the media transport path 350. Alternatively, optical sensor 215 may be located at the print region 303. Usefully, the media comprises a repeating pattern detectable by the method described in U.S. Pat. No. 7,120,272. Alternatively, a number of media detection methods are described in U.S. Pat. No. 6,585,341.

The multivalent metal cations of the present invention are selected from positively charged metal ions derived from the third to the sixth period of the periodic table of the elements, and include but are not limited to: $Mg^{2+}$, $Ca^{2+}$, $Ba^{2+}$, $Al^{3+}$, $Zn^{2+}$, $Zr^{2+}$, $Ni^{2+}$, $Co^{2+}$, $Cu^{2+}$, $Fe^{2+}$, $Fe^{3+}$. Metal cations forming "low-color-differential" complexes with suitable ligands are useful, and advantageously are selected from $Ca^{2+}$ and $Mg^{2+}$. The term "low-color-differential" is herein defined as the presence of the complex in the dry media of the invention is not discernable with the unaided eye compared to dry media absent the complex. The formal charge on the metal cation may be either +2 or +3. A formal charge of +2 is suitable.

A ligand molecule is herein defined as any molecule whose stability constant, $\log K_1$, for formation of a 1:1 complex with the multivalent cation (K1=[M·L]/([M]×[L])) is greater than zero. Some typical ligand molecules form chelate complexes with multivalent metal cations, meaning that at least two atoms on the ligand associate with the metal cation. Ligands useful in the invention comprise any molecule capable of forming with the multivalent metal cation a 1:1 complex characterized by a stability constant less than 6.0. Suitably, the stability constant is at least 0.3 and desirably, at least 0.5. Advantageously, the stability constant is at least 0.6. A stability constant no more than 3.0 is suitable, and no more than 2.0 is desirable. Values for K1, the stability constant for a 1:1 combination of the metal cation and the ligand, for various combinations of multivalent metal cation and ligand are provided in Chemistry of the Metal Chelate Compounds, A. E. Martel and M. Calvin (Prentice Hall, Englewood Cliffs, N.J., 1952).

Useful ligand molecules that form a chelate complex with a metal cation possess a formal charge in aqueous solution ranging from 4 to zero. Advantageously the formal charge is −1. Suitable charge-bearing groups may be any of the useful ionized functionalities employed in the art including, but not restricted to, carboxylate, sulfonate, and phosphonate. A desirable functionality is carboxylate. Suitable but non-limiting examples of molecules whose anions comprise the chelating anions of the invention include: acetic acid, citric acid, gluconic acid, glycine, lactic acid, salicylic acid, tartartic acid, and trimetaphosphate. Advantageously, the ligand molecules comprise a carboxylate function with a hydroxyl group located in an alpha position relative to the carboxylate function.

Often, the complexes are available as neutral salts having a defined stochiometric ratio of ligand to metal ion, for example, of 1:1 or 2:1. In one or more image-receiving layers of the invention, the mole ratio of said ligand molecules to multivalent metal cations is typically at least 0.5:1. A mole ratio at least 1:1 is useful. A mole ratio at least 2:1 is desirable. Advantageously the mole ratio is at least 4:1. Typically the mole ratio does not exceed 20:1. Suitable mole ratios do not exceed 10:1.

The total amount of multivalent metal cation distributed in one or more image receiving layers of the inkjet media typically is at least 0.10 mmol/$m^2$. Suitable amounts of multivalent metal cation are at least 0.5 mol/$m^2$. Desirably the amount is at least 1.0 mmol/$m^2$. Typically, the amount of multivalent metal cation is limited to no more than 10.0 mmol/$m^2$. Suitable amounts of multivalent metal cation are no more than 5.0 mmol/$m^2$.

The ink compositions known in the art of inkjet printing may be aqueous or solvent-based, and in a liquid, solid, or gel state at room temperature and pressure. Aqueous-based ink compositions are preferred because they are more environmentally friendly as compared to solvent-based inks, plus most printheads are designed for use with aqueous-based inks.

The ink composition may be colored with pigments, dyes, polymeric dyes, loaded-dye/latex particles, or any other types of colorants, or combinations thereof. Pigment-based ink compositions are used because such inks render printed images giving comparable optical densities with better resistance to light and ozone as compared to printed images made from other types of colorants. The colorant in the ink composition may be yellow, magenta, cyan, black, gray, red, violet, blue, green, orange, brown, etc.

A challenge for inkjet printing is the stability and durability of the image created on the various types of inkjet receivers. It is generally known that inks employing pigments as ink colorants provide superior image stability relative to dye based inks for light fade and fade due to environmental pollutants especially when printed on microporous photoglossy receivers. For good physical durability (for example abrasion resistance) pigment based inks can be improved by addition of a binder polymer in the ink composition.

Ink compositions useful in the present invention are aqueous-based. Aqueous-based is defined herein to mean the majority of the liquid components in the ink composition are water, preferably greater than 50% water, and more preferably greater than 60% water.

The water compositions useful in the invention may also include humectants and/or co-solvents in order to prevent the ink composition from drying out or crusting in the nozzles of the printhead, aid solubility of the components in the ink composition, or facilitate penetration of the ink composition into the image-recording media after printing. Representative examples of humectants and co-solvents used in aqueous-based ink compositions include: (1) alcohols such as methyl alcohol, ethyl alcohol, n-propyl alcohol, isopropyl alcohol, n-butyl alcohol, sec-butyl alcohol, t-butyl alcohol, iso-butyl alcohol, furfuryl alcohol, and tetrahydrofururyl alcohol; (2) polyhydric alcohols such as ethylene glycol, diethylene glycol, triethylene glycol, tetraethylene glycol, propylene glycol, polyethylene glycol, polypropylene glycol, 1,2-propane diol, 1,3-propane diol, 1,2-butane diol, 1,3-butane diol, 1,4-butane diol, 1,2-pentane diol, 1,5-pentanediol, 1,2-hexanediol, 1,6-hexane diol, 2-methyl-2,4-pentanediol, 1,2-heptane diol, 1,7-hexane diol, 2-ethyl-1,3-hexane diol, 1,2-octane diol, 2,2,4-trimethyl-1,3-pentane diol, 1,8-octane diol, glycerol, 1,2,6-hexanetriol, 2-ethyl-2-hydroxymethyl-propane diol, saccharides and sugar alcohols, and thioglycol; (3) lower mono- and di-alkyl ethers derived from the polyhydric alcohols such as ethylene glycol monomethyl ether, ethylene glycol monobutyl ether, ethylene glycol monoethyl ether acetate, diethylene glycol monomethyl ether, and diethylene glycol monobutyl ether acetate; (4) nitrogen-containing compounds such as urea, 2-pyrrolidone, N-methyl-2-pyrrolidone, 1-(2-hydroxyethyl)-2-pyrrolidinone, and 1,3-dimethyl-2-imidazolidinone; and (5) sulfur-containing compounds such as 2,2'-thiodiethanol, dimethyl sulfoxide, and tetramethylene sulfone.

The ink compositions useful in the invention are pigment-based because such inks render printed images having higher optical densities and better resistance to light and ozone as compared to printed images made from other types of colorants. Pigments that may be used in the inks useful in the invention include those disclosed in, for example, U.S. Pat. Nos. 5,026,427; 5,085,698; 5,141,556; 5,160,370; and 5,169,436. The exact choice of pigments will depend upon the specific application and performance requirements such as color reproduction and image stability.

Pigments suitable for use in the invention include, but are not limited to, azo pigments, monoazo pigments, disazo pigments, azo pigment lakes, b-Naphthol pigments, Naphthol AS pigments, benzimidazolone pigments, disazo condensation pigments, metal complex pigments, isoindolinone and isoindoline pigments, polycyclic pigments, phthalocyanine pigments, quinacridone pigments, perylene and perinone pigments, thioindigo pigments, anthrapyrimidone pigments, flavanthrone pigments, anthanthrone pigments, dioxazine pigments, triarylcarbonium pigments, quinophthalone pigments, diketopyrrolo pyrrole pigments, titanium oxide, iron oxide, and carbon black.

Typical examples of pigments that may be used include Color Index (C. I.) Pigment Yellow 1, 2, 3, 5, 6, 10, 12, 13, 14, 16, 17, 62, 65, 73, 74, 75, 81, 83, 87, 90, 93, 94, 95, 97, 98, 99, 100, 101, 104, 106, 108, 109, 110, 111, 113, 114, 116, 117, 120, 121, 123, 124, 126, 127, 128, 129, 130, 133, 136, 138, 139, 147, 148, 150, 151, 152, 153, 154, 155, 165, 166, 167, 168, 169, 170, 171, 172, 173, 174, 175, 176, 177, 179, 180, 181, 182, 183, 184, 185, 187, 188, 190, 191, 192, 193, 194; C. I. Pigment Red 1, 2, 3, 4, 5, 6, 7, 8, 9, 10, 11, 12, 13, 14, 15, 16, 17, 18, 21, 22, 23, 31, 32, 38, 48:1, 48:2, 48:3, 48:4, 49:1, 49:2, 49:3, 50:1, 51, 52:1, 52:2, 53:1, 57:1, 60:1, 63:1, 66, 67, 68, 81, 95, 112, 114, 119, 122, 136, 144, 146, 147, 148, 149, 150, 151, 164, 166, 168, 169, 170, 171, 172, 175, 176, 177, 178, 179, 181, 184, 185, 187, 188, 190, 192, 194, 200, 202, 204, 206, 207, 210, 211, 212, 213, 214, 216, 220, 222, 237, 238, 239, 240, 242, 243, 245, 247, 248, 251, 252, 253, 254, 255, 256, 258, 261, 264; C.I. Pigment Blue 1, 2, 9, 10, 14, 15:1, 15:2, 15:3, 15:4, 15:6, 15, 16, 18, 19, 24:1, 25, 56, 60, 61, 62, 63, 64, 66, bridged aluminum phthalocyanine pigments; C.I. Pigment Black 1, 7, 20, 31, 32; C. I. Pigment Orange 1, 2, 5, 6, 13, 15, 16, 17, 17:1, 19, 22, 24, 31, 34, 36, 38, 40, 43, 44, 46, 48, 49, 51, 59, 60, 61, 62, 64, 65, 66, 67, 68, 69; C.I. Pigment Green 1, 2, 4, 7, 8, 10, 36, 45; C.I. Pigment Violet 1, 2, 3, 5:1, 13, 19, 23, 25, 27, 29, 31, 32, 37, 39, 42, 44, 50, and mixtures thereof.

Self-dispersing pigments that are dispersible without the use of a dispersant or surfactant may also be useful in the invention. Pigments of this type are those that have been subjected to a surface treatment such as oxidation/reduction, acid/base treatment, or functionalization through coupling chemistry, such that a separate dispersant is not necessary. The surface treatment can render the surface of the pigment with anionic, cationic or non-ionic groups. See for example, U.S. Pat. Nos. 6,494,943 and 5,837,045. Examples of self-dispersing type pigments include CAB-O-JET 200 and CAB-O-JET 300 (Cabot Corporation) and BONJET CW-1, CW-2 and CW-3 (Orient Chemical Industries, Ltd.). In particular, a self-dispersing carbon black pigment ink may be employed in the ink set useful in the invention, wherein ink comprises a water soluble polymer containing acid groups neutralized by an inorganic base, and the carbon black pigment comprises greater than 11 weight % volatile surface functional groups as disclosed in commonly assigned, copending US Patent Publication No. 2008/0206465, the disclosure of which is incorporated by reference herein.

Pigment-based ink compositions useful in the invention may be prepared by any method known in the art of inkjet printing. Useful methods commonly involve two steps: (a) a dispersing or milling step to break up the pigments to primary particles, where primary particle is defined as the smallest identifiable subdivision in a particulate system; and (b) a dilution step in which the pigment dispersion from step (a) is diluted with the remaining ink components to give a working strength ink.

The milling step (a) is carried out using any type of grinding mill such as a media mill, ball mill, two-roll mill, three-roll mill, bead mill, and airjet mill, an attritor, or a liquid interaction chamber. In the milling step (a), pigments are optionally suspended in a medium that is typically the same as or similar to the medium used to dilute the pigment dispersion in step (b). Inert milling media are optionally present in the milling step (a) in order to facilitate break up of the pigments to primary particles. Inert milling media include such materials as polymeric beads, glasses, ceramics, metals, and plastics as described, for example, in U.S. Pat. No. 5,891,231. Milling media are removed from either the pigment dispersion obtained in step (a) or from the ink composition obtained in step (b).

A dispersant is optionally present in the milling step (a) in order to facilitate break up of the pigments into primary particles. For the pigment dispersion obtained in step (a) or the ink composition obtained in step (b), a dispersant is optionally present in order to maintain particle stability and prevent settling. Dispersants suitable for use in the invention include, but are not limited to, those commonly used in the art of inkjet printing. For aqueous pigment-based ink compositions, useful dispersants include anionic, cationic or nonionic surfactants such as sodium dodecylsulfate, or potassium or sodium oleylmethyltaurate as described in, for example, U.S. Pat. Nos. 5,679,138; 5,651,813; or 5,985,017.

Polymeric dispersants are also known and useful in aqueous pigment-based ink compositions. Polymeric dispersants may be added to the pigment dispersion prior to, or during the milling step (a), and include polymers such as homopolymers and copolymers; anionic, cationic, or nonionic polymers; or random, block, branched, or graft polymers. Polymeric dispersants useful in the milling operation include random and block copolymers having hydrophilic and hydrophobic portions; see for example, U.S. Pat. Nos. 4,597,794; 5,085,698; 5,519,085; 5,272,201; 5,172,133; or 6,043,297; and graft copolymers; see for example U.S. Pat. Nos. 5,231,131; 6,087,416; 5,719,204; or 5,714,538. Suitable polymeric dispersants include, for example, terpolymers of benzylmethacrylate, octadecylmethacrylate and methacrylic acid disclosed in co-assigned US Patent Publications 2007/0043146 and US 2007/0043144 and U.S. patent application Ser. Nos. 12/234,742 and 12/234,744.

Composite colorant particles having a colorant phase and a polymer phase are also useful in aqueous pigment-based inks useful in the invention. Composite colorant particles are formed by polymerizing monomers in the presence of pigments; see for example, US Patent Publication Numbers 2003/0199614, 2003/0203988, or 2004/0127639. Microencapsulated-type pigment particles are also useful and consist of pigment particles coated with a resin film; see for example U.S. Pat. No. 6,074,467.

The pigments used in the ink composition useful in the invention may be present in any effective amount, generally from 0.1 to 10% by weight, and preferably from 0.5 to 6% by weight.

Inkjet ink compositions may also contain non-colored particles such as inorganic particles or polymeric particles. The use of such particulate addenda has increased over the past several years, especially in inkjet ink compositions intended for photographic-quality imaging. For example, U.S. Pat. No. 5,925,178 describes the use of inorganic particles in pigment-based inks in order to improve optical density and rub resistance of the pigment particles on the image-recording media. In another example, U.S. Pat. No. 6,508,548 describes the use of a water-dispersible polymeric latex in dye-based inks in order to improve light and ozone resistance of the printed images.

The ink composition may contain non-colored particles such as inorganic or polymeric particles in order to improve gloss differential, light and/or ozone resistance, waterfastness, rub resistance and various other properties of a printed image; see for example, U.S. Pat. No. 6,598,967 or U.S. Pat. No. 6,508,548. Colorless ink compositions that contain non-colored particles and no colorant may also be used. For example, US Patent Publication No. 2006/0100307 describes an inkjet ink comprising an aqueous medium and microgel particles. Colorless ink compositions are often used in the art as "fixers" or insolubilizing fluids that are printed under, over, or with colored ink compositions in order to reduce bleed between colors and waterfastness on plain paper; see for example U.S. Pat. Nos. 5,866,638 or 6,450,632. Colorless inks are also used to provide an overcoat to a printed image, usually in order to improve scratch resistance and waterfastness; see for example, US Patent Publication No. 2002/0009547 or EP 1,022,151. Colorless inks are also used to reduce gloss differential in a printed image; see for example, U.S. Pat. No. 6,604,819; or US Patent Publication Numbers 2003/0085974; 2003/0193553; or 2003/0189626.

Examples of inorganic particles useful in inks used in the invention include, but are not limited to, alumina, boehmite, clay, calcium carbonate, titanium dioxide, calcined clay, aluminosilicates, silica, or barium sulfate.

For aqueous-based inks, polymeric binders useful in the invention include water-dispersible polymers generally classified as either addition polymers or condensation polymers, both of which are well-known to those skilled in the art of polymer chemistry. Examples of polymer classes include acrylics, styrenics, polyethylenes, polypropylenes, polyesters, polyamides, polyurethanes, polyureas, polyethers, polycarbonates, polyacid anhydrides, and copolymers consisting of combinations thereof. Such polymer particles can be ionomeric, film-forming, non-film-forming, fusible, or heavily cross-linked and can have a wide range of molecular weights and glass transition temperatures.

Examples of useful polymeric binders include styrene-acrylic copolymers sold under the trade names JONCRYL (S.C. Johnson Co.), UCAR (Dow Chemical Co.), JONREZ (MeadWestvaco Corp.), and VANCRYL (Air Products and Chemicals, Inc.); sulfonated polyesters sold under the trade name EASTMAN AQ (Eastman Chemical Co.); polyethylene or polypropylene resin emulsions and polyurethanes (such as the WITCOBONDS from Witco Corporation). These polymers are preferred because they are compatible in typical aqueous-based ink compositions, and because they render printed images that are highly durable towards physical abrasion, light, and ozone.

The non-colored particles and binders useful in the ink composition used in the invention may be present in any effective amount, generally from 0.01 to 20% by weight, and preferably from 0.01 to 6% by weight. The exact choice of materials will depend upon the specific application and performance requirements of the printed image.

Ink compositions may also contain water-soluble polymer binders. The water-soluble polymers useful in the ink composition are differentiated from polymer particles in that they are soluble in the water phase or combined water/water-soluble solvent phase of the ink. The term "water-soluble" herein is defined as when the polymer is dissolved in water and when the polymer is at least partially neutralized the resultant solution is visually clear. Included in this class of polymers are nonionic, anionic, amphoteric and cationic polymers. Representative examples of water soluble polymers include, polyvinyl alcohols, polyvinyl acetates, polyvinyl pyrrolidones, carboxy methyl cellulose, polyethyloxazolines, polyethyleneimines, polyamides and alkali soluble resins; polyurethanes (such as those found in U.S. Pat. No. 6,268,101), polyacrylic type polymers such as polyacrylic acid and styrene-acrylic methacrylic acid copolymers (such as JONCRYL 70 from S.C. Johnson Co., TRUDOT IJ-4655 from MeadWestvaco Corp., and VANCRYL 68S from Air Products and Chemicals, Inc.).

Examples of water-soluble acrylic type polymeric additives and water dispersible polycarbonate-type or polyether-type polyurethanes which may be used in the inks of the ink sets useful in the invention are described in commonly assigned US Application Publications 2008/0207820 and 2008/0207811, the disclosures of which are incorporated by reference herein. Polymeric binder additives useful in the inks used in the invention are also described in for example US Patent Publication Numbers 2006/0100307 and 2006/0100308.

In practice, ink static and dynamic surface tensions are controlled so that inks of an ink set can provide prints with the desired inter-color bleed. In particular, it has been found that the dynamic surface tension at 10 milliseconds surface age for all inks of the ink set comprising cyan, magenta, yellow, and black pigment-based inks and a colorless protective ink should be greater than or equal to 35 mN/m, while the static surface tensions of the yellow ink and of the colorless protective ink should be at least 2.0 mN/m lower than the static surface tensions of the cyan, magenta and black inks of the ink set, and the static surface tension of the colorless protective ink should be at least 1.0 mN/m lower than the static surface tension of the yellow ink, in order to provide acceptable performance for inter-color bleed on both microporous photoglossy and plain paper. It is generally preferred that the static surface tension of the yellow ink is at least 2.0 mN/m lower than all other inks of the ink set excluding the clear protective ink, and the static surface tension of the clear protective ink is at least 2.0 mN/m lower than all other inks of the ink set excluding the yellow ink.

Surfactants may be added to adjust the surface tension of the inks to appropriate levels. The surfactants may be anionic, cationic, amphoteric or nonionic and used at levels of 0.01 to 5% of the ink composition. Examples of suitable nonionic surfactants include, linear or secondary alcohol ethoxylates (such as the TERGITOL 15-S and TERGITOL TMN series available from Union Carbide and the BRIJ series from Uniquema), ethoxylated alkyl phenols (such as the TRITON series from Union Carbide), fluoro surfactants (such as the ZONYLS from DuPont; and the FLUORADS from 3M), fatty acid ethoxylates, fatty amide ethoxylates, ethoxylated and propoxylated block copolymers (such as the PLURONIC and TETRONIC series from BASF, ethoxylated and propoxylated silicone based surfactants (such as the SILWET series from CK Witco), alkyl polyglycosides (such as the GLUCOPONS from Cognis) and acetylenic polyethylene oxide surfactants (such as the SURFYNOLS from Air Products and Chemicals, Inc.).

Examples of anionic surfactants include; carboxylated (such as ether carboxylates and sulfosuccinates), sulfated (such as sodium dodecyl sulfate), sulfonated (such as dodecyl benzene sulfonate, alpha olefin sulfonates, alkyl diphenyl oxide disulfonates, fatty acid taurates, and alkyl naphthalene sulfonates), phosphated (such as phosphated esters of alkyl and aryl alcohols, including the STRODEX series from Dexter Chemical, L.L.C.), phosphonated and amine oxide surfactants, and anionic fluorinated surfactants. Examples of amphoteric surfactants include: betaines, sultaines, and aminopropionates. Examples of cationic surfactants include: quaternary ammonium compounds, cationic amine oxides, ethoxylated fatty amines, and imidazoline surfactants. Additional examples of the above surfactants are described in "McCutcheon's Emulsifiers and Detergents: 2003, North American Edition."

A biocide may be added to an inkjet ink composition to suppress the growth of micro-organisms such as molds, fungi, etc. in aqueous inks. A preferred biocide for an ink composition is PROXEL GXL (Arch UK Biocides, Ltd.) at a final concentration of 0.0001-0.5 wt. %. Additional additives which may optionally be present in an inkjet ink composition include thickeners, conductivity enhancing agents, anti-kogation agents, drying agents, waterfast agents, dye solubilizers, chelating agents, binders, light stabilizers, viscosifiers, buffering agents, anti-mold agents, anti-curl agents, stabilizers, and defoamers.

The pH of the aqueous ink compositions useful in the invention may be adjusted by the addition of organic or inorganic acids or bases. Useful inks may have a preferred pH of from about 2 to 10, depending upon the type of dye or pigment being used. Typical inorganic acids include hydrochloric, phosphoric, and sulfuric acids. Typical organic acids include methanesulfonic, acetic, and lactic acids. Typical inorganic bases include alkali metal hydroxides and carbonates. Typical organic bases include ammonia, triethanolamine, and tetramethylethlenediamine.

The exact choice of ink components will depend upon the specific application and performance requirements of the printhead from which they are jetted. Thermal and piezoelectric drop-on-demand printheads and continuous printheads each require ink compositions with a different set of physical properties in order to achieve reliable and accurate jetting of the ink, as is well known in the art of inkjet printing. Acceptable viscosities are no greater than 20 cP, and preferably in the range of about 1.0 to 6.0 cP.

For color inkjet printing, a minimum of cyan, magenta and yellow inks are required for an inkjet ink set which is intended to function as a subtractive color system. Very often black ink is added to the ink set to decrease the ink required to render dark areas in an image and for printing of black and white documents such as text. The need to print on both microporous photoglossy and plain paper receivers may be met by providing a plurality of black inks in an ink set. In this case, one of the black inks may be better suited to printing on microporous photoglossy receivers while another black ink may be better suited to printing on plain paper. Use of separate black ink formulations for this purpose can be justified based on desired print densities, printed gloss, and smudge resistance for the type of receiver.

Other inks can be added to the ink set. These inks include light or dilute cyan, light or dilute magenta, light or dilute black, red, blue, green, orange, gray, and the like. Additional inks can be beneficial for image quality but they add system complexity and cost. Finally, colorless ink composition can be added to the inkjet ink set for the purpose of providing gloss uniformity, durability and stain resistance to areas in the printed image which receive little or no ink otherwise. Even for image areas printed with a significant level of colorant containing inks, the colorless ink composition can be added to those areas with further benefits. An example of a protective ink for the above purposes is described in US Patent Publication Numbers 2006/0100306 and 2006/0100308.

In describing the invention herein, the following definitions generally apply:

The term "single coating pass" or "one coating pass" refers to a coating operation comprising coating one or more layers, optionally at one or more stations, in which the coating operation occurs prior to winding the inkjet recording material in a roll. A coating operation, in which further a coating step occurs before and again after winding the inkjet recording material on a roll, but prior to winding the inkjet recording material in a roll a second time, is referred to as a two-pass coating operation.

The term "post-metering method" is defined herein to mean a method in which the coating composition is metered after coating, by removing excess material that has been coated.

The term "pre-metering method" is defined herein to mean a direct metering method, by which is meant a method in which the coating composition is metered before coating, for example, by a pump. Pre-metered methods can be selected from, for example, curtain coating, extrusion hopper coating, and slide hopper coating.

The term "porous layer" is used herein to define a layer that is characterized by absorbing applied ink primarily by means of capillary action rather than liquid diffusion. The porosity is based on pores formed by the spacing between particles, although porosity can be affected by the particle to binder ratio. The porosity of a layer may be predicted based on the critical pigment volume concentration (CPVC). An inkjet recording media having one or more porous layers, preferably substantially all layers, over the support can be referred to as a "porous inkjet recording media" even though at least the support is not considered porous.

Particle sizes referred to herein, unless otherwise indicated, are median particle sizes as determined by light scattering measurements of diluted particles dispersed in water, as measured using laser diffraction or photon correlation spectroscopy (PCS) techniques employing NANOTRAC (Microtac Inc.), MALVERN, or CILAS instruments or essentially equivalent means, which information is often provided in product literature. For particle sizes greater than 0.3 micrometers, particle measurements are by a Micromeritics SEDIGRAPH 5100 or equivalent means. For particle sizes not more than about 50 nm, particle measurements are by direct methods, transmission electron microscopy (TEM) of a representative sample or equivalent means. Unless otherwise indicated particle sizes refer to secondary particle size.

As used herein, the terms "over," "above," "upper," "under," "below," "lower," with respect to layers in inkjet media, refer to the order of the layers over the support, but do not necessarily indicate that the layers are immediately adjacent or that there are no intermediate layers.

The term "image-receiving layer" is intended to define a layer that is used as a pigment-trapping layer, dye-trapping layer, or dye-and-pigment-trapping layer, in which the printed image substantially resides on the surface of or throughout the layer. Typically, an image-receiving layer comprises a mordant for dye-based inks. In the case of a dye-based ink, the image may optionally reside in more than one image-receiving layer.

The term "base layer" (sometimes also referred to as a "sump layer" or "ink-carrier-liquid receptive layer") is used herein to mean a layer under at least one other ink-retaining layer that absorbs a substantial amount of ink-carrier liquid. In use, a substantial amount, often most, of the carrier fluid for the ink is received in the base layer. The base layer is not above an image-containing layer and is not itself an image-containing layer (a pigment-trapping layer or dye-trapping layer). Typically, the base layer is the ink-retaining layer nearest the support.

The term "ink-receptive layer" or "ink-retaining layer" includes any and all layers above the support that are receptive to an applied ink composition, that absorb or trap any part of the one or more ink compositions used to form the image in the inkjet recording element, including the ink-carrier fluid and/or the colorant, even if later removed by drying. An ink-receptive layer, therefore, can include an image-receiving layer, where the image is formed by a dye and/or pigment, a base layer, or any additional layers, for example between a base layer and a topmost layer of the inkjet recording element. Typically, all layers above the support are ink-receptive. The support on which ink-receptive layers are coated may also absorb ink-carrier fluid, in which it is referred to as an ink-absorptive or absorbent layer rather than an ink-receptive layer.

Image-recording elements (also termed herein, inkjet media or inkjet receivers) suitable for receiving ink from an inkjet printer are typically used in sheet form and include plain paper, coated paper, synthetic paper, textiles, and films.

Typically a plain paper comprises cellulose fibers, microparticles of water-insoluble inorganic filler for increased weight, opacity and brightness; sizing agents to control fluid uptake; and optionally water-soluble salts of multivalent metallic cations. Examples of plain papers include KODAK Ultra Paper, KODAK Premium Inkjet Paper and KODAK Everyday Inkjet Paper.

Synthetic paper refers to microporous polymer sheets comprising voids and optionally fillers. TESLIN (PPG) is a polyolefin sheet comprising silica particles.

Photographic quality image-recording media typically comprise a support, and coated upon the support, at least one image-receiving layer. The support may be any suitable support, such as plain paper, resin-coated paper, synthetic paper, or polymeric film. The support and the coating layer thereon may be opaque, semi-transparent or transparent, and their surfaces may be smooth or textured, depending on the type of display and illumination intended for viewing.

A single-layer design may suffice for everyday photo-quality media. As described above, porous media typically comprise particles and a relatively small amount of binder. The ratio of particles to binder depends on particle size and optional internal porosity of the particles. Typically the layer comprises at least 50 percent by weight of inorganic particles to provide porosity, suitably at least 80 percent by weight, desirably at least 90 percent by weight, advantageously at least 95 percent by weight. Typically an ink-receiving layer comprises at least 2 percent by weight of binder, typically at least 4 percent binder. Sufficient binder is used to prevent cracking upon drying after coating. The amount of binder is desirably limited, because when ink is applied to inkjet media, the (typically aqueous) liquid carrier tends to swell the binder and close the pores and may cause coalescence, puddling, bleeding or other problems. To maintain porosity, therefore, the layer comprises less than 25 percent by weight, suitably less than 18 percent by weight, desirably less than 10 percent by weight of binder.

Any useful polymeric binder may be used in a typical layer of the inkjet recording element employed in the invention. In a suitable embodiment, the polymeric binder may be any compatible, hydrophilic polymer such as a poly(vinyl alcohol), poly(vinyl pyrrolidone), gelatin, cellulose ether, poly (oxazoline), poly(vinylacetamide), partially hydrolyzed poly (vinyl acetate/vinyl alcohol), poly(acrylic acid), poly (acrylamide), poly(alkylene oxide), sulfonated or phosphated polyesters and polystyrenes, casein, zein, albumin, chitin, chitosan, dextran, pectin, collagen derivatives, collodian, agar-agar, arrowroot, guar, carrageenan, tragacanth, xanthan, or rhamsan. Desirably, the hydrophilic polymer is poly(vinyl alcohol), hydroxypropyl cellulose, hydroxypropyl methyl cellulose, a poly(alkylene oxide), poly(vinyl pyrrolidinone), poly(vinyl acetate) or copolymers thereof, or gelatin. In general, good results are also obtained with polyurethanes, vinyl acetate-ethylene copolymers, ethylene-vinyl chloride copolymers, vinyl acetate-vinyl chloride-ethylene terpolymers, acrylic polymers, or derivatives thereof. Typically, the binder is a water-soluble hydrophilic polymer, most suitably a polyhydric alcohol such as a poly(vinyl alcohol).

Other binders can also be used in a typical layer of the image recording element such as hydrophobic materials, for example, a poly(styrene-co-butadiene) latex, polyurethane latex, polyester latex, poly(n-butyl acrylate), poly(n-butyl methacrylate), poly(2-ethylhexyl acrylate), copolymers of n-butylacrylate and ethylacrylate, and copolymers of vinylacetate and n-butylacrylate. A poly(styrene-co-butadiene) latex is especially suitable. Mixtures of hydrophilic and latex binders are useful, and a mixture of PVA with a poly(styrene-co-butadiene) latex is particularly suitable.

In order to impart mechanical durability to the base layer, crosslinkers that act upon the binder discussed above may be added in small quantities. Such an additive improves the cohesive strength of the layer. Further, crosslinker restrains swelling of the binder when ink fluid is absorbed, thus helping to maintain porosity. Crosslinkers such as carbodiimides, polyfunctional aziridines, aldehydes, isocyanates, epoxides, polyvalent metal cations, vinyl sulfones, pyridinium, pyridylium dication ether, methoxyalkyl melamines, triazines, dioxane derivatives, chrom alum, zirconium sulfate, boric acid, or a borate salt may be used. Typically, the crosslinker is an aldehyde, an acetal, or a ketal such as 2,3-dihydroxy-1,4-dioxane, or a boron compound.

Particles useful for porous layers in inkjet media include organic polymeric particles and inorganic particles. Examples of organic particles that may be used in a layer include polymer beads, including but not limited to acrylic resins such as methyl methacrylate, styrenic resins, cellulose derivatives, polyvinyl resins, ethylene-allyl copolymers, and polycondensation polymers such as polyesters. Hollow styrene beads are a preferred organic particle for certain applications.

Other examples of organic particles that may be used include core/shell particles such as those disclosed in U.S. Pat. No. 6,492,006 and homogeneous particles such as those disclosed in U.S. Pat. No. 6,475,602.

Typically porous inkjet media comprise water-insoluble inorganic particles. Useful particles include, but are not restricted to, metallic and semi-metallic oxides, carbonates, and sulfates. Desirable particles are colorless in the visible spectrum. Examples of useful particles employed in the art include oxides of silicon, aluminum and titanium, calcium carbonate and barium sulfate.

Calcium carbonate particles may be ground, that is milled from natural deposits, or synthetically precipitated. Precipitated calcium carbonate (PCC) particles may take several forms including prismatic, acicular, and rosette (scalenohedral). Commonly-assigned U.S. patent application Publication Numbers 2007/0134450 and 2007/0218222 disclose the use of precipitated and ground calcium carbonate in combination with scalenohedral PCC in porous inkjet receivers and are hereby incorporated by reference.

Examples of calcium carbonate particles useful in the present invention include: HYDROCARB HG (Omya, ground calcium carbonate), OPACARB (Specialty Minerals, PCC, acicular), ALBACAR HO (Specialty Minerals, PCC, rosette (scalenohedral)), and ALBAGLOS S (Specialty minerals, PCC, prismatic).

Clays are generally crystalline hydrous phyllosilicates of one or more of aluminum, iron, and magnesium, comprising layers of tetrahedral and octahedral coordination of the metallic or semi-metallic atoms variously arranged, and further comprising intervening layers of hydration, according to the mineral type. Kaolin has the composition $Al_2O_3.2SiO_2.2H_2O$. Kaolin typically is used as a filler in the manufacture of paper, wherein it is mixed with the pulp fibers, and is known in the art for its brightness and opacity. The process of calcining, i.e., heat-treating kaolin at about 500 to 1000 C, dehydroxylates the kaolin, leaving an amorphous aluminosilicate phase capable of providing improved brightness and opacity Examples of kaolin that can be used in the present invention include KAOGLOSS 90 (available from Thiele), POLYGLOSS 90 (Huber), and HYDRAFINE 90 (Huber).

Silicon and aluminum oxides may be prepared in various forms by methods that roughly may be divided into wet and dry process (gas phase or vapor phase process). The latter type of particles is also referred to as fumed or pyrogenic particles. In a vapor phase method, flame hydrolysis methods and arc methods have been commercially used. Fumed particles exhibit different properties than non-fumed or hydrated particles. Fumed or pyrogenic particles are aggregates of smaller, primary particles. Although the primary particles are not porous, the aggregates contain a significant void volume, and hence are capable of rapid liquid absorption. Inkjet recording media incorporating fumed silica particles are described in U.S. patent application Ser. No. 11/936,819, hereby incorporated by reference. Examples of suitable fumed silica particles include AEROSIL 200 (Evonik) and CAB-O-SPERSE PG002 (Cabot). Fumed alumina particles, for selective optional use in the present invention, are described in U.S. Pat. Nos. 6,887,559 and 7,431,993. Examples of fumed alumina particles useful in the invention include CAB-O-SPERSE PG003 and PG008 (Cabot). The primary particle sizes of fumed silica or fumed alumina range from about 5 nm to about 50 nm. The secondary aggregate particle size useful for inkjet receivers is from about 90 nm to about 500 nm. Desirably, a secondary particle size less than 300 nm may provide improved gloss. Advantageously, the secondary particle size is less than 250 nm. Suitably, the secondary particle size is at least 150 nm.

Silicon oxide particles formed by wet methods include colloidal silica, precipitated silica and silica gel. The term "colloidal silica" refers to particles comprising silicon dioxide that are dispersed to become colloidal. Such colloidal particles characteristically are primary particles that are substantially spherical. Colloidal silica particles are commercially available from a number of manufacturers, including Nissan Chemical Industries, Evonik, Grace Davison (SYLOJET and LUDOX), and Nalco Chemical Co. Useful primary particle sizes range from 12 nm to 90 nm. Precipitated silica made by a wet process comprises aggregates of primary particles. Silica gel comprises primary particles arranged in a network and is characterized by a relatively large degree of internal porosity.

Chemical treatment of particles to add moieties possessing an opposite charge permits the natural charge of the particle to be reversed. Surface charge of particles may be characterized by the zeta potential, which is the electrical potential between the dispersion medium and the stationary layer of fluid attached to the dispersed particle. The zeta potential may be estimated by measuring the electrophoretic mobility, according to ASTM Standard D 4187-82 (1985).

A cationic surface modifier providing a positive charge is desired since it renders the particles dispersible and chemically compatible with other components of adjacent ink receiving layers such as mordants, surfactants, and other positively charged particulates. Suitably, the zeta potential of the treated particles is at least +20 mV at any point between pH 2 to 6. This is desirable because the colloidal stability of the particles tends to increase with increasing zeta potential.

Silica particles and clay particles typically have a surface occupied predominantly by negatively charged moieties and may be treated with a cationic surface modifier. The cationic surface modifier is positively charged or capable of providing a positive charge when associated with an anionic particle, and may be molecular, polymeric, or particulate. Molecular species suitable as cationic surface modifiers include weak organic bases such as amines and amides, quaternary amines, and organic and inorganic cations capable of binding to the surface of the clay particles. Polymeric materials suitable for practice of the invention are selected from cationic polyelectrolytes. Well-known examples include polydiallyldimethylammonium chloride (p-DADMAC) and copolymers of epichlorohydrin/dimethylamine. Particulate materials suitable as cationic surface modifiers for anionic particles include metal oxides and insoluble metal salts having a positive zeta potential at any point between about pH 2 to 7. Positively charged latex particles such a polystyrenes and poly(methyl) methacrylates are also contemplated.

Suitably, one or more materials in an ink-receiving layer comprise particles of hydrated or unhydrated aluminum oxide. Advantageously, the particles are substantially non-aggregated colloidal particles. Desirably, the particles comprise a hydrated alumina that is an aluminum oxyhydroxide material, for example, and boehmite.

The term "hydrated alumina" is herein defined by the following general formula:

$$Al_2O_{3-n}(OH)_{2n}.mH_2O$$

wherein n is an integer of 0 to 3, and m is a number of 0 to 10, preferably 0 to 5. In many cases, $mH_2O$ represents an aqueous phase that does not participate in the formation of a crystal lattice, but is able to be eliminated. Therefore, m may take a value other than an integer. However, m and n are not 0 at the same time.

The term "hydrated alumina" is herein defined by the above formula when m and n are both zero at the same time and includes fumed alumina, made in a dry phase process or anhydrous alumina $Al_2O_3$ made by calcining hydrated alumina. As used herein, such terms as unhydrated alumina apply to the dry materials used to make coating compositions during the manufacture of the inkjet media, notwithstanding any hydration that occurs after addition to water.

A crystal of the hydrated alumina showing a boehmite structure is generally a layered material, the (020) plane of which forms a macro-plane, and shows a characteristic diffraction peak. Besides a perfect boehmite, a structure called pseudo-boehmite and containing excess water between layers of the (020) plane may be taken. The X-ray diffraction pattern of this pseudo-boehmite shows a diffraction peak broader than that of the perfect boehmite. Since perfect boehmite and pseudo-boehmite may not be clearly distinguished from each other, the term "boehmite" or "boehmite structure" is herein used to include both unless indicated otherwise by the context. For the purposes of this specification, the term "boehmite" implies boehmite and/or pseudoboehmite. Examples of boehmite crystals are CATAPAL 200 (Sasol), DISPERAL HP 14 (Sasol), and DISPAL 14N4-80 (Sasol).

Porous inkjet media are constructed with one or more ink receiving layers. Typically only the fluid portion of the ink penetrates to lower layers, which provide capacity to hold the liquid in the pores until it can evaporate, yet provide instantly after printing a dry feel and appearance on the surface. Desirably the colorant is trapped at or near the surface in order to provide maximum color density. The uppermost layer is designed in part to provide the desired surface appearance. Finer particles typically provide higher gloss, while larger particles are employed for a matte appearance. The surface also depends on the nature of the support. For example, a resin-coated support provides a high gloss media and a textured RC support provides a satin finish. Plain paper coated with a base layer of for example calcium carbonate and treated to calendering also provides a smooth surface for glossy inkjet media. Examples of one-, two- and three-layer structures typically used for inkjet media are listed below.

Single Layer

Structure I

Photo-quality inkjet media comprising a single porous layer may be prepared from a coating composition comprising fine clay particles (HYDRAGLOSS 90, Huber, 0.2 micron), fumed silica particles (AEROSIL 200, Evonik), polyvinyl alcohol (GOHSENOL KH-20, Nippon Gohsci), first surfactant (alkyl poly glucoside, APG-325, Cognis)), second surfactant non-ionic fluorosurfactant ZONYL FS-300, DuPont), for example, in a weight ratio of 750/250/40/3.5/10. The coating composition is coated on a plain paper of suitable weight for photographs. Publication-quality (gloss or semi-gloss) inkjet receivers comprising a single porous layer may be prepared from a coating composition comprising the fine clay particles, PVA, crosslinker and surfactants, coated on plain paper as disclosed in Example 1 of commonly-owned U.S. application Ser. No. 11/855,377, herein incorporated by reference.

Two-Layer (Structure IIA)

Commonly assigned, co-pending U.S. patent application Ser. No. 11/936,815 discloses an inkjet recording element having a support and a porous base layer comprising particles of anionic filmed silica and hydrophilic hydroxyl-containing polymer as the primary binder crosslinked with a crosslinker comprising a boron-containing compound. The porous base layer has a dry weight of about 10 to 35 g/m$^2$, wherein the weight percent of total binder to total solids in the porous base layer is greater than 5.0 percent and less than 15.0 percent. Optimized for dye-based inks, the uppermost porous gloss layer above the porous base layer advantageously comprises particles of colloidal silica and hydrophilic binder and has a dry weight of about 1.0 to 7.5 g/m$^2$. The median particle size of the particles of colloidal silica is about 10 to under 45 nm. Optimized for pigment-based inks the optional uppermost porous gloss layer above the porous base layer comprises particles of anionic colloidal silica and hydrophilic binder and has a dry weight of about 0.2 to 7.5 g/m$^2$. Suitable particles of anionic filmed silica and anionic colloidal silica exhibit a zeta potential below negative 15 mV.

(Structure IIB)

A porous two-layer inkjet receiving material coated on plain paper support is described by Sadasivan et al., in commonly assigned U.S. Pat. No. 6,689,430. The inkjet recording element comprises a base layer coated to form a layer with a dry weight of 27 g/m$^2$ on a plain paper support. The base layer comprises inorganic pigments, precipitated calcium carbonate (PCC) and silica gel, and binders, polyvinyl alcohol and styrene-butadiene latex. One of the main functions of the base layer is to provide a sump for the ink fluids in the applied ink as distinguished from the colorants, whether dye or pigment-based. The image-receiving layer is coated over the dried base layer in the amount of 8.6 g/in$^2$ using a coating composition comprising a mixture of colloidal alumina and fumed alumina particles, PVA binder, cationic polymeric latex dispersion, and coating aids. Base layer formulas providing improved ink absorption and image quality are described in commonly assigned US Patent Publication Numbers 2007/0134450 and 2007/0218222 disclosing a base layer comprising a mixture of PCC of scalenohedral crystal shape with either a PCC or a ground calcium carbonate of different morphology.

(Structure IIC)

Commonly assigned, co-pending U.S. patent application Ser. No. 12/183,699 discloses a base layer composition comprising cationically modified clay particles enabling improved ink absorption and lower coat weight in a two-layer inkjet media than that disclosed in '450. A further advantage is provided by the selection of coating compositions containing particles with only cationic surface charge. Such compositions may be simultaneously coated in stacked layers at one coating station, providing significant manufacturing efficiencies.

Three-Layer (Structure IIIA)

In commonly assigned US Patent Publication No. 2007/0202279, Schultz, et al., describe a porous three-layer ink-receiving material coated on plain paper support. The porous base layer comprises anionic pigments, for example, precipitated calcium carbonate (PCC) and silica gel, and binders, for example, poly(vinyl alcohol) and styrene-butadiene latex, and a total dry weight of at least 25 g/m$^2$. One of the main functions of the base layer in a three-layer material is to provide a smoother substrate than a raw paper upon which to coat the upper layers. In addition, the porous base layer may provide a sump for the ink fluids in the ink applied to the uppermost layer by the printer. Schultz, et al. describe a porous intermediate layer present in an amount of at least 25 g/m$^2$ comprising colloidal alumina and a porous top layer comprising alumina in an amount of at least 1 g/m$^2$. The porous top layer comprises a mixture of fumed alumina and colloidal alumina. The base layer is coated by a post-metering method, e.g. rod coating, followed by drying and then the upper two layers are coated simultaneously by a pre-metering method, e.g. curtain coating. The material is calendered at least once, optionally at any time after the initial base-layer coating, to provide a 20-degree gloss of at least 15 Gardner units in its unprinted state.

(Structure IIIB)

Commonly assigned, co-pending U.S. patent application Ser. No. 12/183,658 discloses a base layer composition comprising cationically modified clay particles enabling improved ink absorption and significantly lower coat weight in a three-layer inkjet media than that disclosed in '279. A further advantage is provided by the selection of coating compositions containing particles with only cationic surface charge. Such compositions may be simultaneously coated in stacked layers at one coating station, providing significant manufacturing efficiencies.

(Structure IIIC)

Commonly assigned, co-pending U.S. patent application Ser. No. 12/026,935 discloses inkjet media prepared on resin-coated (RC) paper support. On the front side of the support is coated three layers in order from the support, a foundation layer, an intermediate layer and a top layer. The foundation layer composition comprises colloidal alumina particles (CATAPAL 200, Sasol, 140 nm particles), binder poly (vinyl alcohol) (GH-23, Gohsenol), crosslinkers glyoxal (CATABOND GHF) and boric acid, and surfactants (non-ionic surfactant Olin 10 G and alkyl poly glucoside, APG-325, Cognis) coated at 6.5 g solids/m$^2$. The intermediate layer comprises colloidal alumina particles (CATAPAL 200, Sasol, 140 nm particles), binder poly (vinyl alcohol) (GH-23, Gohsenol), crosslinkers glyoxal (CARTABOND GHF) and boric acid, and surfactants (OLIN 10 G and APG 325) coated at 60 g solids/m$^2$. The top layer comprises fumed alumina particles (PG-008, Cabot, 130 nm particles), binder poly (vinyl alcohol (GH-23, Gosenol), latex dispersion of polymeric cationic mordant as described in commonly assigned U.S. Pat. No. 6,045,917, ono-ionic fluorosurfactant (ZONYL FSN, DuPont), and crosslinkers glyoxal (CARTABOND GHF) and boric acid at coated at 2.2 g/m$^2$.

Since the inkjet media may come in contact with other image recording articles or the drive or transport mechanisms of image-recording devices, additives such as surfactants, lubricants, matte particles and the like may be added to the inkjet recording element to the extent that they do not degrade the properties of interest.

The present inkjet media, or a sheet material that is divided into separate elements, may be made by various coating methods which may include, but are not limited to, wound wire rod coating, slot coating, slide hopper coating, gravure, and curtain coating. Some of these methods allow for simultaneous coatings of two or more layers, which is preferred from a manufacturing economic perspective.

The inkjet recording material is advantageously manufactured by a process of coating in one pass upon at least one surface of a support, by a pre-metering method, up to three coating compositions independently comprising inorganic particles, binder, other addenda described herein, and optionally surfactant to provide optionally, a base layer on the support, optionally an intermediate layer upon the base layer or support, and an uppermost layer upon the intermediate layer, base layer or support; and then drying the coated layer or layers. If desired, the dried layers may then be subjected to calendering with pressure and optionally heat to improve smoothness and gloss.

Typically the base, intermediate and uppermost layer coating compositions independently comprise at least 20 percent solids, suitably at least 25 percent solids, desirably at least 30 percent solids. Advantageously, the composition comprises at least 50% solids. In an advantageous embodiment, the two or three layers are simultaneously coated by a pre-metering method. Advantageously, the layers are coated by the method of curtain coating.

Optional other layers, including subbing layers, overcoats, further intermediate layers between the base layer and the upper layer, and the like may be coated by conventional coating means onto a support material commonly used in this art. Preferably, the base layer and the intermediate layers are the only layers comprising more than 5 g/m$^2$ dry weight.

The multivalent metallic cation(s) and chelating ligand(s) may be added to the coating composition for the image-recording layer. Alternatively, the ions may be coated in an auxiliary layer, for example a subbing layer, an intermediate layer or an overcoat layer, so that an effective amount of the ions diffuse to an image-recording layer prior to completion of drying of the final coated composition. The ions may be added directly to the coating compositions, or separate solutions of soluble salts of the cation and ligand may be separately added. In another embodiment, the dried media may be overcoated with a wash solution of the ions, that is a non-layer-forming solution absorbed by the dry media, and allowed to dry prior to packaging of the media. Alternatively, multiple wash solutions each comprising separately one soluble salt of the cation or of the ligand may be separately applied.

EXAMPLES

All ratios recited in the examples are molar ratios unless specified as weight ratios. In the following descriptions it is understood that ingredients routinely used in the art may be added without significant effect on the results attributed to the invention. The substances include, for example, biocides (KORDEK MLX), surfactants (SURFYNOL 465, STRODEX PK-90, TERGITOL 15-S-5), dynamic surface tension agents (1,2-hexanediol), humectant (ethylene glycol, glycerol, 2-pyrrolidinone, 1-(2-hydroxyethyl)-2-pyrrolidinone, and triethylene glycol, and pH-adjusting agents (triethanolamine and KOH).

A first set of pigment-based inks (Ink Set I) comprising cyan, magenta and yellow inks, C-1, M-1 and Y-1, respectively, was prepared according to the descriptions given in co-assigned US Patent Publication No. 2008/0207805, Table I and the accompanying explanation. An additional Ink Set II, comprising inks C-2, M-2, and Y-2 was prepared comprising the following variations from Set I. The pigment in M-2 was CIBA 2BC and the pigment in Y-2 was PY-74. The pigments in C-2, M-2 and Y-2 were dispersed with a terpolymer of benzylmethacrylate, octadecylmethacrylate and methacrylic acid. The acrylic polymer binder of Ink Set I was not included. The polyurethane-polycarbonate binder was replaced in C-2 and M-2 with a polyurethane-polyether binder having an acid number of 100. In Y-2, a portion of the polyurethane-polycarbonate binder was replaced by another polyurethane-polycarbonate binder having an acid number of 135.

Example 1

Comparative

Inkjet receivers according to structure I were prepared. Aqueous coating compositions 1 through 9 were prepared at 23% solids by weight comprising clay particles (HYDRAGLOSS 90, Huber), fumed silica particles (AEROSIL 200, Evonik), polyvinyl alcohol (saponification degree ca. 80% GOHSENOL KH-20, Nippon Gohsei), first surfactant (alkyl poly glucoside, APG-325, Cognis), second surfactant (non-ionic fluorosurfactant, ZONYL FS-300, DuPont), in a weight ratio of 750/250/40/3.5/10. Additionally, a water-soluble salt of a multivalent cation was dissolved in the compositions. Table 1 shows the identity and relative amount of salt added to compositions 1 through 9. The compositions were coated onto a low-size paper of 151 g basis weight by a bead coating method and dried to produce coatings 1 through 9.

TABLE 1

| Coating | Salt | mmol/m$^2$ |
|---|---|---|
| 1 | None | — |
| 2 | $CaCl_2*2H_2O$ | 4.3 |
| 3 | $CaCl_2*2H_2O$ | 7.5 |
| 4 | $CaCl_2*2H_2O$ | 10.8 |
| 5 | $CaCl_2*2H_2O$ | 15.1 |
| 6 | $MgCl_2*6H_2O$ | 4.3 |
| 7 | $MgCl_2*6H_2O$ | 7.5 |
| 8 | $MgCl_2*6H_2O$ | 10.8 |
| 9 | $MgCl_2*6H_2O$ | 15.1 |

Samples of dried coatings were printed with a KODAK EASYSHARE 5000 series printer loaded with pigment ink set II.

The printed image was a step target having increasing ink fluid laydowns as shown in Table 2. The green patch of each sample was visually rated for coalescence, with severe coalescence rated 5, and no observable coalescence rated 1. The rating of coalescence is given in Table 2 for coatings 1 through 9

TABLE 2

| Ink Laydown Green Patch | | Visual rating of Coalescence Coating #* | | | | | | | | |
|---|---|---|---|---|---|---|---|---|---|---|
| Step | mL/m$^2$ | 1 | 2 | 3 | 4 | 5 | 6 | 7 | 8 | 9 |
| 140 | 17.2 | 5 | 1 | 1 | 1 | 1 | 1 | 1 | 1 | 1 |
| 160 | 19.3 | 5 | 1 | 1 | 1 | 1 | 1 | 1 | 1 | 1 |
| 180 | 20.2 | 5 | 1 | 1 | 1 | 1 | 1 | 1 | 1 | 1 |
| 200 | 21.0 | 5 | 1 | 1 | 1 | 1 | 1 | 1 | 1 | 1 |
| 220 | 22.5 | 5 | 2 | 1 | 1 | 1 | 2 | 1 | 1 | 1 |
| 240 | 23.9 | 5 | 2 | 1 | 1 | 1 | 2 | 1 | 1 | 1 |
| 260 | 25.7 | 5 | 2 | 2 | 1 | 1 | 2 | 2 | 1 | 1 |

*1-5: $CaCl_2$ 6-9: $MgCl_2$

Severe coalescence was observed for coating 1, containing no added salt, at all levels of printed ink shown in Table 2, whereas all the salt-containing coatings 2 through 9 bad acceptable levels of coalescence. The threshold amount of printed ink at which coalescence was first observed, that is, when a rating above 1 was obtained, appeared to increase for samples with larger relative amounts of salt.

The 60-degree gloss of the green test patch target was measured on a BYK Gardner Gloss Meter for samples 1 through 9 and the results are shown in Table 3.

TABLE 3

| Ink Laydown Green Patch | | Gloss Coating #* | | | | | | | | |
|---|---|---|---|---|---|---|---|---|---|---|
| Step | mL/m$^2$ | 1 | 2 | 3 | 4 | 5 | 6 | 7 | 8 | 9 |
| 140 | 17.2 | 60 | 34 | 29 | 28 | 28 | 64 | 54 | 51 | 49 |
| 160 | 19.3 | 61 | 28 | 24 | 25 | 25 | 59 | 46 | 47 | 46 |
| 180 | 20.2 | 61 | 26 | 23 | 25 | 25 | 57 | 45 | 45 | 43 |
| 200 | 21.0 | 54 | 25 | 22 | 24 | 24 | 55 | 43 | 43 | 42 |
| 220 | 22.5 | 62 | 22 | 20 | 22 | 23 | 52 | 40 | 39 | 38 |
| 240 | 23.9 | 63 | 20 | 20 | 22 | 22 | 49 | 37 | 37 | 36 |
| 260 | 25.7 | 64 | 19 | 20 | 22 | 20 | 44 | 35 | 37 | 33 |

*1-5: $CaCl_2$ 6-9: $MgCl_2$

The results shown in Table 3 demonstrate that the use of a water-soluble salt of a divalent metal ion results in a moderate to severe reduction in the desired gloss when a pigment-based ink is printed on a glossy porous inkjet receiver. While the addition of the salt is noted for reduction of objectionable coalescence, the resulting loss of printed gloss is unsuitable for a glossy photographic print.

Example 2

Coatings 11 though 31 were prepared as in Example 1, except that additional types of salts were investigated. The salts comprised multivalent metal cations with multivalent anions capable of chelating metal ions. Magnesium citrate ($Mg_3(C_6H_5O_7)_2.9H_2O$) is not sufficiently soluble for direct addition to coating compositions In this case, magnesium chloride and sodium citrate were added separately in amounts sufficient to provide the desired amount of each species in the coating. The formation constant K1 of the 1:1 complexes were obtained from Chemistry of the Metal Chelate Compounds, A. E. Martel and M. Calvin, Prentice Hall, Englewood Cliffs, N.J., 1952). Samples of the coatings were printed as in Example 1 and the green patch at Step 200 (ink laydown of 21.0 mL/m$^2$ was evaluated for coalescence and 60-degree gloss as in Comparative Example 1. The results of the evaluations are shown in Table 4.

TABLE 4

| Coating | Salt | K1 | mmol/m$^2$ | Gloss | Coalescence | Type |
|---|---|---|---|---|---|---|
| 11 | None | — | — | 80 | 5 | Comp |
| 12 | $MgCl_2$*$6H_2O$ | — | 4.3 | 40 | 1 | Comp |
| 16 | $Mg(Gluconate)_2$*$H_2O$ | 0.7 | 4.3 | 55 | 1 | Inv |
| 20 | $Mg(Lactate)_2$*$H_2O$ | 0.9 | 5.4 | 56 | 1 | Inv |
| 24 | MgCitrate | 3.2 | 4.3 | 54 | 3 | Inv |
| 28 | MgEDTA | 8.7 | 4.3 | 70 | 5 | Comp |
| 13 | $MgCl_2$*$6H_2O$ | — | 7.5 | 34 | 1 | Comp |
| 17 | $Mg(Gluconate)_2$*$H_2O$ | 0.7 | 7.5 | 46 | 1 | Inv |
| 21 | $Mg(Lactate)_2$*$H_2O$ | 0.9 | 8.6 | 52 | 1 | Inv |
| 25 | MgCitrate | 3.2 | 7.5 | 51 | 3 | Inv |
| 29 | MgEDTA | 8.7 | 7.5 | 68 | 5 | Comp |
| 14 | $MgCl_2$*$6H_2O$ | — | 10.8 | 28 | 1 | Comp |
| 18 | $Mg(Gluconate)_2$*$H_2O$ | 0.7 | 10.8 | 42 | 1 | Inv |
| 22 | $Mg(Lactate)_2$*$H_2O$ | 0.9 | 11.8 | 48 | 1 | Inv |
| 26 | MgCitrate | 3.2 | 10.8 | 44 | 3 | Inv |
| 30 | MgEDTA | 8.7 | 10.8 | 62 | 5 | Comp |
| 15 | $MgCl_2$*$6H_2O$ | — | 15.1 | 21 | 1 | Comp |
| 19 | $Mg(Gluconate)_2$*$H_2O$ | 0.7 | 15.1 | 39 | 1 | Inv |
| 23 | $Mg(Lactate)_2$*$H_2O$ | 0.9 | 17.2 | 49 | 1 | Inv |
| 27 | MgCitrate | 3.2 | 15.1 | 12 | 3 | Inv |
| 31 | MgEDTA | 8.7 | 15.1 | 58 | 5 | Comp |

The results in Table 4 show that coalescence is effectively reduced by the presence of multivalent metal cations. However, in the presence of a strongly chelating multivalent anion, for example, EDTA, for which the complex formation constant with Mg ion is 8.7, the improvement in coalescence is not observed. While not wishing to be bound by any particular theory, it appears that the multivalent metal cations are capable of immobilizing ink droplets on the surface of the receiver by complexing with anionic polymers, especially bridging carboxylate-containing polymers, in the ink; the strong complexation ability of EDTA renders the multivalent metal ion unavailable to the carboxylate-containing polymers in the ink, and hence there is no effect of the multivalent metal cation on the immobilization of the printed ink droplet in the presence of strongly chelating anions of EDTA.

Surprisingly, the loss of gloss in printed areas attributed to the presence of multivalent metal cations shows a remarkable improvement when a ligand capable of chelating the metal cation is present. In the presence of gluconate, lactate, or citrate anions, the average increase in gloss at equimolar Mg ion concentrations is at least 15 units compared to the presence of non-chelating chloride anions. It is believed that the chelating anions compete with ink polymer carboxylate groups for ligand sites on the metal thereby limiting the growth of bridged aggregates. Smaller aggregates scatter less light giving the gloss enhancement.

A comparison of gloss over a broad range of printed ink laydowns is shown in Table 5, where a non-chelating anion, chloride is compared to chelating anion, lactate, in combination with a stoichiometric amount of Mg ion.

TABLE 5

| Ink Laydown Green Patch | | $MgCl_2$*$6H_20$ 60 deg Gloss | | | | $Mg(Lactate)_2$*$H_20$ 60 deg Gloss | | | |
|---|---|---|---|---|---|---|---|---|---|
| | | Coating # | | | | | | | |
| Step | mL/m$^2$ | 12 | 13 | 14 | 15 | 20 | 21 | 22 | 23 |
| 140 | 17.2 | 55.0 | 49.2 | 42.3 | 32.9 | 61.6 | 62.1 | 56.8 | 57.0 |
| 160 | 19.3 | 46.2 | 40.4 | 33.8 | 25.3 | 59.1 | 56.5 | 53.4 | 53.7 |
| 180 | 20.2 | 42.6 | 37.2 | 30.8 | 22.9 | 58.6 | 53.9 | 50.2 | 51.0 |
| 200 | 21.0 | 40.1 | 33.6 | 28.1 | 21.1 | 55.9 | 51.6 | 48.0 | 49.1 |
| 220 | 22.5 | 35.5 | 29.8 | 24.8 | 18.1 | 51.4 | 47.3 | 45.2 | 45.4 |
| 240 | 23.9 | 33.0 | 27.4 | 22.6 | 16.6 | 47.7 | 45.8 | 44.0 | 43.6 |
| 260 | 25.7 | 27.0 | 21.6 | 17.0 | 14.2 | 43.0 | 41.0 | 39.7 | 39.7 |

Pairwise comparison at comparable molar concentrations, for example, coating 12 compared to coating 20, or coating 13 compared to coating. 21, shows that, at all printed ink laydowns, superior gloss is achieved with a combination of multivalent metal cation and a chelating anionic ligand, for example, lactate, compared to the combination of a multivalent metal cation and a non-chelating anion, for example, chloride ion.

Coalescence and 60-degree gloss were determined for the above target green patches at the lowest Mg ion concentrations, coatings 12 and 20, and a further comparison coating 11 that had no added magnesium ion. In place of the visual assessment of coalescence used in the preceding examples, the values of L* mottle were measured with a PIAS-II handheld image analyzer from Quality Engineering Associates, Inc., Burlington, Mass. 01803. The low magnification head on the instrument was used in conjunction with the Area Analysis software to read L* mottle, which is the standard deviation of L* values within the region of interest, using a tile size of 413 microns square. Values greater than 1.2 correspond to easily visible non-uniformity in the printed region at normal viewing distance, and values less than about 1.2 have acceptable visual uniformity at normal viewing distance. The results of the L* mottle measurements are given in Table 6.

TABLE 6

| Target Ink Laydown | | Coating 11 | | Coating 12 | | Coating 20 | |
|---|---|---|---|---|---|---|---|
| Step | mL/m$^2$ | Gloss | Mottle | Gloss | Mottle | Gloss | Mottle |
| 140 | 17.2 | 76 | 3.7 | 55 | 1.4 | 62 | 1.1 |
| 160 | 19.3 | 77 | 5.3 | 46 | 1.5 | 59 | 1.2 |
| 180 | 20.2 | 79 | 6.2 | 43 | 1.5 | 59 | 1.1 |
| 200 | 21.0 | 80 | 6.8 | 40 | 1.5 | 56 | 1.2 |
| 220 | 22.5 | 78 | 7.9 | 36 | 1.5 | 51 | 1.2 |
| 240 | 23.9 | 74 | 8.9 | 33 | 1.6 | 48 | 1.1 |
| 260 | 25.7 | 72 | 9.2 | 27 | 1.8 | 43 | 1.1 |

Reduced mottle was obtained for the sample containing a combination of Mg ion with lactate anion compared to the sample containing a combination of Mg ion with chloride ion and to the sample containing no Mg ion. Furthermore, the 60-degree gloss of the sample containing the combination of Mg ion with lactate ion was superior to the sample containing the combination of Mg ion with chloride ion.

Example 3

An inkjet receiver comprising a top layer and a base layer was prepared on a polyethylene resin-coated (RC) paper support to produce a first-tier glossy photo paper similar to KODAK Ultra Premium Photo Paper, except that the base layer thickness and capacity were reduced by approximately one-half. The coating composition for the base layer comprised colloidal alumina particles (CATAPAL 200, 140 nm diameter, Sasol), poly (vinyl alcohol) (saponification degree 88, GOHSENOL GH-23, Nippon Gohsei), cross-linking compound glyoxal (CARTABOND GHF, Clariant) and boric acid, and surfactant (non-ionic, OLIN 10 G, Olin) in a relative weight ratio of 95.0/4.5/0.13/0.25. The base layer coating composition comprised 32% solids and was coated at 34.4 g solids/m$^2$. The coating composition for the top layer comprised fumed alumina particles (PG-008, 130 nm diameter, Cabot), poly (vinyl alcohol) (GOHSENOL GH-23, Nippon Gohsei), latex dispersion of polymeric cationic mordant as described in U.S. Pat. No. 6,045,917 as Mordant 2, boric acid, and non-ionic fluorosurfactant (ZONYL FSN, DuPont) in a relative ratio of 77.7/4.5/15.0/0.13/2.7. The coating composition comprised 32% solids and was coated above the base layer at 2.2 g/m$^2$. Samples of the dried receiver were coated with solutions prepared by mixing various amounts of either 0.2 M $MgCl_2$ or 0.2 M $CaCl_2$, and 0.4 M sodium lactate to give varying mole ratios of either magnesium-to-lactate or calcium-to-lactate ions. These solutions were coated to give the dry coverages of the ions as shown in Table 7. After drying, a step target was printed with a Kodak Easyshare Series 5000 all-in-one inkjet printer wherein the red step-200 patch had a total ink fluid laydown of 27.9 mL/m$^2$. The 20-degree gloss and mottle were measured as in Example 2 above.

TABLE 7

| Sample | Salt 2.15 (mmol/m$^2$) | Sodium lactate (mmol/m$^2$) | Gloss | Mottle |
|---|---|---|---|---|
| 32 | None | 0.0 | 122. | 2.15 |
| 33 | $MgCl_2$*$6H_20$ | 0.0 | 2.4 | 0.96 |
| 34 | $MgCl_2$*$6H_20$ | 2.15 | 6.9 | 0.71 |
| 35 | $MgCl_2$*$6H_20$ | 4.30 | 22. | 0.64 |
| 36 | $MgCl_2$*$6H_20$ | 8.60 | 33. | 0.66 |
| 38 | $CaCl_2$*$2H_20$ | 0.0 | 0.5 | 0.60 |
| 39 | $CaCl_2$*$2H_20$ | 2.15 | 1.0 | 0.68 |
| 40 | $CaCl_2$*$2H_20$ | 4.30 | 2.5 | 0.63 |
| 41 | $CaCl_2$*$2H_20$ | 8.60 | 14.1 | 0.65 |

Sample 32, without added Mg ion, displayed a high printed gloss but displayed an unacceptably high mottle. With added Mg ion, sample 33 showed acceptable mottle, but the gloss was unacceptably low. Addition of lactate ion at equimolar concentration to Mg ion demonstrated improved mottle and significantly improved gloss. However, the gloss level did not meet the gloss requirement for a first-tier glossy photo paper. Sample 35, with a lactate-to-magnesium ratio of 2.0, equivalent to that of the salt, demonstrated further improvement in mottle and a dramatic tripling of the gloss value. Sample 36, in which the lactate-to-magnesium ratio is 4.0, twice that of the salt, showed yet another 50% increase in gloss relative to Sample 35. Similar results were found for calcium ion, with an even more dramatic gloss enhancement when the lactate-to-calcium ratio is raised from the stoichiometric salt ratio 2.0, to twice the salt ratio 4.0. These data demonstrate that mottle may be minimized and gloss improved dramatically by combining a chelating ligand with a multivalent metal cation in a molar ratio greater than the stoichiometric salt ratio.

An additional printing experiment was conducted on Samples 32 and 38-41, in which they were printed with Ink Set I, comprising non-polymeric dispersant and different polymeric binders than Ink Set II. A step target was printed with a Kodak Easyshare Series 5000 all-in-one inkjet printer wherein the green step-200 patch had a total ink fluid laydown of 21.0 mL/m$^2$. The 20-degree gloss and mottle were measured as in Example 2 above. The image quality results are displayed in Table 8.

TABLE 8

| Sample | Salt 2.15 (mmol/m$^2$) | Sodium lactate (mmol/m$^2$) | Gloss | Mottle |
|---|---|---|---|---|
| 32 | None | 0.0 | 91.8 | 2.11 |
| 38 | $CaCl_2$*$2H_20$ | 0.0 | 37.7 | 1.96 |
| 39 | $CaCl_2$*$2H_20$ | 2.15 | 65.0 | 1.53 |
| 40 | $CaCl_2$*$2H_20$ | 4.30 | 82.7 | 1.06 |
| 41 | $CaCl_2$*$2H_20$ | 8.60 | 88.3 | 0.99 |

Comparative Sample 32 shows very high gloss, but extreme mottle. The presence of calcium chloride in Sample 38 reduces unwanted mottle, but as a consequence, the gloss is reduced to a low level. The combination of calcium chloride and sodium lactate in Sample 39 provides a further reduction of mottle and restores a significant portion of the gloss lost compared to the presence of calcium chloride alone. As the molar ratio of sodium lactate to calcium chloride is increased from 1:1 to 2:1 and 4:1 in Samples 40 and 41, respectively, further improvements in gloss and mottle are noted. The results of the example demonstrate the efficacy of the combination of multivalent metal cation and chelating ligand with pigment-based inks comprising both polymeric and non-polymeric dispersants, a variety of binders including polyurethanes and acrylics, and a variety of humectants.

Example 4

An inkjet receiver was prepared as in Example 3 without added multivalent cation or chelating ligand, except that the base layer coverage was increased to 68.9 g solids/$m^2$, comparable to KODAK Ultra Premium Photo Paper. Under identical printing conditions, the higher coated weight photo paper, without the multivalent cation or chelating ligand, provided a high printed gloss, but did not exhibit coalescence. Inventive Sample 36 of Example 3, with half the coated weight in the base layer provides very low mottle and good gloss in comparison to the standard heavier-weight coating. With the combination of multivalent metal cation and anion capable of chelating the multivalent metal cation, the coating weight may be halved, providing a savings in material used and providing a productivity increase and energy savings through reduction in drying requirements.

Alternative embodiments of the invention may provide reduced coalescence, bleed, smearing, and sensitivity to extremes of humidity, improved manufacturability, transport through a printer, image quality, dry time, color density, gloss, abrasion and scratch resistance, resistance to cracking, layer adhesion, water-fastness, image stability, resistance to image fade attributable to ambient gases or visible or UV light exposure, reduced gloss artifacts, such as differential gloss and color gloss, and reduced curl during manufacturing, storage, printing, or drying.

This invention has been described in detail with particular reference to certain preferred embodiments thereof, but it will be understood that variations and modification can be effected within the spirit and scope of the invention. The entire contents of the patents and other publications referred to in this specification are incorporated herein by reference.

| PARTS LIST | |
|---|---|
| 10 | inkjet printer |
| 12 | image data source |
| 18 | ink tanks |
| 20 | recording media supply |
| 22 | printed media collection |
| 30 | printhead |
| 40 | protective cover |
| 100 | carriage |
| 215 | optical sensor |
| 302 | media direction |
| 303 | print region |
| 304 | media direction |
| 312 | feed roller(s) |
| 313 | forward direction |
| 320 | pickup roller(s) |
| 322 | turn roller(s) |
| 323 | idler roller(s) |
| 324 | discharge roller(s) |
| 325 | star wheel(s) |
| 350 | media transport path |

-continued

| PARTS LIST | |
|---|---|
| 360 | media supply tray |
| 371 | media sheet |
| 375 | further optical sensor |
| 380 | media output tray |
| 390 | printed media sheet |

The invention claimed is:

1. An inkjet printing system, comprising: a printer, an ink composition comprising pigment colorant and a carboxylate-containing anionic polymer, and a dry recording media supply for receiving ink, the dry recording media supply for receiving ink comprising a support bearing an ink-receiving layer containing a complex of polyvalent metal cation(s) and ligand(s), wherein the complex has a stability constant, log $K_1$, in the range of 0.3 to 6.0, and wherein the mole ratio of ligand to polyvalent metal cation exceeds the stoichiometric ratio of the neutral salt.

2. The system of claim 1 wherein the complex is a low-color-differential complex.

3. The system of claim 1 wherein polyvalent metal cation(s) includes at least one metal that is selected from the group consisting of Mg, Ca, Ba, Al, Zn, Zr, Ni, Co, Cu, and Fe.

4. The system of claim 3 wherein the metal cation(s) include at least one selected from $Mg^{+2}$ and $Ca^{+2}$.

5. The system of claim 1 wherein a ligand bears a charge of −1.

6. The system of claim 1 wherein a ligand bears a charge moiety selected from carboxylate, sulfonate, and phosphonate.

7. The system of claim 6 wherein the charge moiety is carboxylate.

8. The system of claim 1 wherein the stability constant is at least 0.5.

9. The system of claim 1 wherein the stability constant is less than 3.0.

10. The system of claim 1 wherein the ligand is selected from anions of acetic acid, citric acid, gluconic acid, glycine, lactic acid, salicylic acid, tartaric acid, and trimetaphosphate.

11. The system of claim 7 wherein the ligand contains hydroxyl alpha to a carboxylate.

12. The system of claim 1 wherein the mole ratio of ligand to polyvalent metal cation exceeds the stoichiometric ratio of the neutral salt by a factor of 2.

13. The system of claim 1 wherein the mole ratio of the ligand to polyvalent metal cation is less than 20.

14. The system of claim 1 wherein polyvalent metal cation concentration is at least 0.10 mmol/$m^2$ and is less than 10.0 mmol/$m^2$.

15. A dry unprinted inkjet media, comprising a support bearing an ink-receiving layer containing a complex of a polyvalent metal cation and a ligand wherein the complex has a stability constant, log $K_1$, in the range of 0.3 to 6.0, and wherein the mole ratio of ligand to polyvalent metal cation exceeds the stoichiometric ratio of the neutral salt.

16. A process for making an inkjet media containing a support bearing an ink-receiving layer, comprising including in the ink-receiving layer a divalent metal complexed by a ligand, the complex having a stability constant, log $K_1$, in the range of 0.3 to 6.0, and wherein the mole ratio of ligand to divalent metal exceeds the stoichiometric ratio of the neutral salt.

* * * * *